US007331716B2

(12) United States Patent
Nakano et al.

(10) Patent No.: US 7,331,716 B2
(45) Date of Patent: Feb. 19, 2008

(54) FLEXIBLE CONTAINER, METHOD OF FORMING THE FLEXIBLE CONTAINER, SEAL-BREAKING GUIDE OF THE FLEXIBLE CONTAINER, METHOD OF ENCLOSING LIQUID IN THE FLEXIBLE CONTAINER AND THE LIQUID ENCLOSED IN THE FLEXIBLE CONTAINER

(75) Inventors: Yoshimasa Nakano, Shinjuku-Ku (JP); Tadaaki Kurosu, Shinjuku-Ku (JP); Shinichi Inoue, Shinjuku-Ku (JP); Etsuko Hattori, Shinjuku-Ku (JP)

(73) Assignee: Kurita Water Industries Ltd., Tokyo (JP)

( * ) Notice: Subject to any disclaimer, the term of this patent is extended or adjusted under 35 U.S.C. 154(b) by 442 days.

(21) Appl. No.: 10/492,136

(22) PCT Filed: Mar. 11, 2003

(86) PCT No.: PCT/JP03/02854

§ 371 (c)(1),
(2), (4) Date: Apr. 7, 2004

(87) PCT Pub. No.: WO03/078262

PCT Pub. Date: Sep. 25, 2003

(65) Prior Publication Data

US 2004/0258333 A1 Dec. 23, 2004

(30) Foreign Application Priority Data

Mar. 15, 2002 (JP) ..... 2002-072900

(51) Int. Cl.
*B65D 33/00* (2006.01)
*B65D 65/26* (2006.01)

(52) U.S. Cl. ..... 383/203; 383/200; 383/204

(58) Field of Classification Search ..... 383/207, 383/200–202, 203
See application file for complete search history.

(56) References Cited

U.S. PATENT DOCUMENTS 3,815,810 A * 6/1974 Wellman ..... 383/204

(Continued)

FOREIGN PATENT DOCUMENTS

EP 0 465 522 B1 7/1995

(Continued)

OTHER PUBLICATIONS

International Search Report, PCT/JP03/02854, dated May 20, 2003, JPO, 2003.

*Primary Examiner*—Nathan J. Newhouse
*Assistant Examiner*—Jack Morgan
(74) *Attorney, Agent, or Firm*—Connolly Bove Lodge & Hutz LLP

(57) ABSTRACT

There are provided a flexible container capable of realizing facilitation of opening and uniformization of the shape of an opening that is obtained by opening, a method of forming the flexible container, a seal-breaking guide of the flexible container, a method of enclosing a liquid in the flexible container, and the liquid enclosed in the flexible container. The invention relates to the flexible container which is openable by tearing, the method of forming the flexible container, the seal-breaking guide of the flexible container, the method of enclosing a liquid in the flexible container, and the liquid enclosed in the flexible container, and has seal parts (a center seal part 4, a top seal part 6, a bottom seal part 8) for sealing a holding part (2) formed of a flexible material (3), cuts (12, 14) formed in the seal parts and a seal-breaking guide of the flexible container (16) formed in the seal parts for giving guidance for a direction of tearing of the holding part which is openable by tearing, thereby realizing facilitation of opening and uniformization of the shape of an opening that is obtained by opening.

11 Claims, 17 Drawing Sheets

U.S. PATENT DOCUMENTS

| | | | | |
|---|---|---|---|---|
| 3,882,999 | A * | 5/1975 | Wellman | 206/216 |
| 4,027,819 | A * | 6/1977 | Herrera-Gutierrez | 383/204 |
| 4,834,245 | A * | 5/1989 | Ohga et al. | 383/201 |
| 5,613,779 | A * | 3/1997 | Niwa | 383/201 |
| 5,914,142 | A * | 6/1999 | Zartner | 426/113 |
| 6,342,258 | B1 * | 1/2002 | Berings et al. | 426/79 |

FOREIGN PATENT DOCUMENTS

| | | |
|---|---|---|
| EP | 1 055 612 A1 | 11/2000 |
| JP | 11-321893 | 11/1999 |
| WO | WO-90/11946 A1 | 10/1990 |

* cited by examiner

FLEXIBLE CONTAINER, METHOD OF FORMING THE FLEXIBLE CONTAINER, SEAL-BREAKING GUIDE OF THE FLEXIBLE CONTAINER, METHOD OF ENCLOSING LIQUID IN THE FLEXIBLE CONTAINER AND THE LIQUID ENCLOSED IN THE FLEXIBLE CONTAINER

TECHNICAL FIELD

The invention relates to a container and so forth for use in transportation, storage and commercialization of a liquid and so forth, and particularly relates to a flexible container which is openable when torn while formed of a flexible material such as a synthetic resin film and so forth, a method of forming the flexible container, a seal-breaking guide of the flexible container serving as an assistant member when opening the container, a method of enclosing the liquid in the flexible container for use in transportation, storage and commercialization the liquid and so forth, and the liquid enclosed in the flexible container.

BACKGROUND ART

Generally, a plastic container called a PET bottle is heavily used for commercialization, transportation, storage, and so forth, of a drinking water such as a mineral water, and other liquids. It is pointed out, however, that this kind of plastic container is light in weight and high in safety, but is bulky and hard to handle because it is high in rigidity and keeps in a fixed shape regardless of an amount of the contents. As opposed to such a container, a flexible container in bag shape, formed of a plastic film, has been in widespread use. The flexible container is high in holding efficiency in a box or like because it undergoes variation in external shape due to fluidity of its contents, and the flexible container by itself after use is easy to handle because it is small in volume and can be optionally folded and overlaid one on top of another, thereby rendering it less bulky than the PET bottle. Further, the flexible material can be easily scrapped depending on the quality of the contents, and hence it is excellent in ambience.

For example, as shown in FIG. 13, a flexible container 200 in which mineral water is contained has a holding part 202 formed of a flexible material, as the holding part 202 is sealed at upper and lower seal parts 204, 206 by thermo compression bonding. The flexible container 200 employs a synthetic resin sheet such as polyethylene and so forth which is excellent in tearing property. Slits 208 and 210 are formed in the seal part 204 at the two corner sides of the holding part 202, and an arrow 212 indicating a tearing direction of the holding part 202, namely, a direction for opening the holding part 202 from the seal part 204 to the holding part 202, is printed on the holding part 202.

With the flexible container 200 having such a configuration, if a tearing force is applied to a direction of the arrow 212 for opening the cut 208 while picking up both sides of the slit holding part 208 as shown in FIG. 14, the seal part 204 and a part of the holding part 202 are torn so that the holding part 202 in which water is contained is broken to open the holding part 202. Further, as shown in FIG. 15, likewise, the holding part 202 can be opened by tearing the cut 208 in a direction of an arrow 212 while picking up both sides of the cut 208 after a flexible container 200 is put in a stand 214 serving as a reinforcing container. In the case where the stand 214 is used, the holding part 202 can be opened by applying a force to the seal part 204 so as to open the cut 208 with one hand in FIG. 15.

Meanwhile, if the flexible container 200 is formed of a flexible material which is excellent in tearing property, it can be easily opened but the shape of the opening formed by opening the holding part 202 is not uniformized depending on a tearing direction. For example, as evident from each shape of breakage piece 216 formed by being opened from the cut 208 and torn, as shown in FIG. 16(A), 16(B) and 16(C), each opening 218 is variously shaped so that the shape of the opening 218 becomes asymmetrical about the seal part 204 or distorted. If water serving as an contents is to be poured into a cup or the like from the opening 218, a direction of water is changed depending on the shape of the opening 218, resulting in trouble in handling such fail in pouring water into the cup or the like.

Further, in the case shown in FIG. 17, since a holding part 202 is soft, an opening 218 is easily sealed by a clip 220 to prevent water from flowing out, and sealing of the holding part 202 can be easily released by removing the clip 220. In this case, if a flexible container 200 sealed by the clip 220 is kept in a refrigerator, the opening 218 to which sealing pressure is applied is hardened by refrigeration and kept in an close contact state, even if the clip 220 is removed from the opening 218 in the case where a flexible container 200 is formed of a flexible material such as a synthetic resin sheet. Accordingly, there is disadvantage that shaping of the opening 218 takes time when using the flexible container 200 or if a user intends to flow out water through the opening 218 by inclining the flexible container 200 in the close contact state, water is prevented from flowing out, and a flowing direction of water is hardly operable.

Still further, in the case where the opening 218 is sealed by such a clip 220, if an opening area or an opening width of the opening 218 is varied with an arbitrary tearing force, there is a likelihood that the opening 218 can not be sealed by the intended clip 220.

DISCLOSURE OF INVENTION

It is an object of the invention to provide a flexible container which can be easily opened and can be uniformized in the shape of the opening obtained by opening it, and a method of forming the flexible container, a seal-breaking guide of the flexible container, a method of enclosing the liquid in the flexible container, and the liquid enclosed in the flexible container.

To achieve the above object, the flexible container of the invention may be configured such that the flexible container being openable by tearing comprises seal parts for sealing a holding part formed of a flexible material, single or plural cuts formed on the seal parts, and a seal-breaking guide provided in the holding part for giving a guidance for a direction of tearing of the holding part, said holding part being torn from the single or plural cuts to be opened.

To achieve the above object, the flexible container of the invention may be configured such that the cuts are formed by the number of not less than two parts which are selectable in an opening area of the holding part.

To achieve the above object, the flexible container of the invention may be configured such that the seal-breaking guide is closed by a closing member for sealing an opening formed in the holding part by opening it, and maintaining the opening in an open state when the sealing of the opening is released.

To achieve the above object, a method of forming a flexible container of the invention which is openable by tearing may be configured to comprise the steps of bonding a seal-breaking guide for giving a guidance for a direction of tearing of a holding par, when the holding part is opened, to a flexible material forming the holding part for enclosing a liquid therein, and setting seal parts in the flexible material by folding a portion of the flexible material to which the seal-breaking guide is bonded to thereby form the holding part.

To achieve the above object, the seal-breaking guide of the flexible container of the invention may be configured such that the seal-breaking guide of a flexible container which is openable by tearing from cuts formed in seal parts comprises edge parts for preventing tearing from spreading on the holding part, that is torn by the cuts, and for guiding a tearing force, that is applied to the holding part in an operating direction.

To achieve the above object, the seal-breaking guide of a flexible container of the invention may be configured to comprise a slit for preventing tearing from spreading on the holding part, that is torn by the cuts, and for guiding a tearing force, that is applied to the holding part in an operating direction.

To achieve the above object, the seal-breaking guide of a flexible container of the invention may be configured to comprise plural slits for preventing tearing from spreading on the holding part, that is torn by the cuts, and for guiding tearing routes, that are generated in the holding parts, within a predetermined range.

To achieve the above object, the seal-breaking guide of a flexible container of the invention may be configured to comprise an opening in the holding part by collecting tearing routes for tearing the holding part while extending over the seal parts, and a slit for braking the holding part and a part of the seal parts.

To achieve the above object, the seal-breaking guide of a flexible container of the invention may be configured such that the edge parts or slits may be formed in a symmetrical shape at the symmetrical position or an asymmetrical shape at the asymmetrical position while sandwiching the seal part.

To achieve the above object, a method of enclosing a liquid in a flexible container which is openable by tearing may be configured to comprise the steps of bonding a seal-breaking guide to a flexible material, said seal-breaking guide giving a guidance for a direction of tearing when a holding part is opened, setting seal parts by folding a portion of the flexible material to which the seal-breaking guide is bonded to thereby form the holding part of a liquid, charging a predetermined amount of the liquid into the holding part, and sealing the holding part at the seal part after charging the liquid.

To achieve the above object, a liquid of the invention may be configured to be enclosed in the flexible container.

According to the invention, since a direction of tearing the holding part from the slits formed in the seal parts of the flexible container is guided by a seal-breaking guide, the holding part is easily opened by the seal-breaking guide and shape of the opening obtained by opening the holding part 2 is uniformized by the seal-breaking guide, thereby forming substantially the same configuration.

Further, the opening of the holding part is reinforced by the seal-breaking guide, to maintain the shape of the opening, and even if the holding part is sealed by the sealing piece and refrigerated, when the sealing is released, the opening is restored in an open state.

According to the flexible container of the invention, the method of forming the flexible container, the seal-breaking guide of the flexible container, the method of enclosing the liquid in the flexible container and the liquid, there are following effects of advantages.

a. An opening can be easily formed by tearing a part of the flexible container from the slits formed in the seal parts, and a direction of tearing and breaking the holding part is guided by the seal-breaking guide to tear the holding part, realizing uniformization of the shape of the opening by restricting the shape of opening to a predetermined shape so that unevenness of the opening or failure of the opening can be prevented.

b. Since the opening can be reinforced by the seal-breaking guide, the holding part can be easily restored from the close contact state caused by the sealing by a sealing piece or refrigeration to an open state, so that the contents can be easily taken out from the holding part.

c. It is possible to form the flexible container which can be easily opened and the opening configuration can be uniformized.

d. It is possible to enclose contents such as a liquid and so forth in the flexible container which can be easily opened and the opening configuration can be uniformized, and hence it is possible to commercialize a liquid such as pure water, drinking water and so forth.

e. It is possible to commercialize the flexible container which can be easily opened and the opening configuration is uniformized as a unit, and it is possible to provide a liquid such as pure water and a drinking water which is facilitated in conveyance and storage.

The above and other objects, configurations and advantages of the invention will become more apparent from the following detailed description of the preferred embodiments with reference to the accompanying drawings.

BEST MODE FOR CARRYING OUT THE INVENTION

First Embodiment

Figure 1:
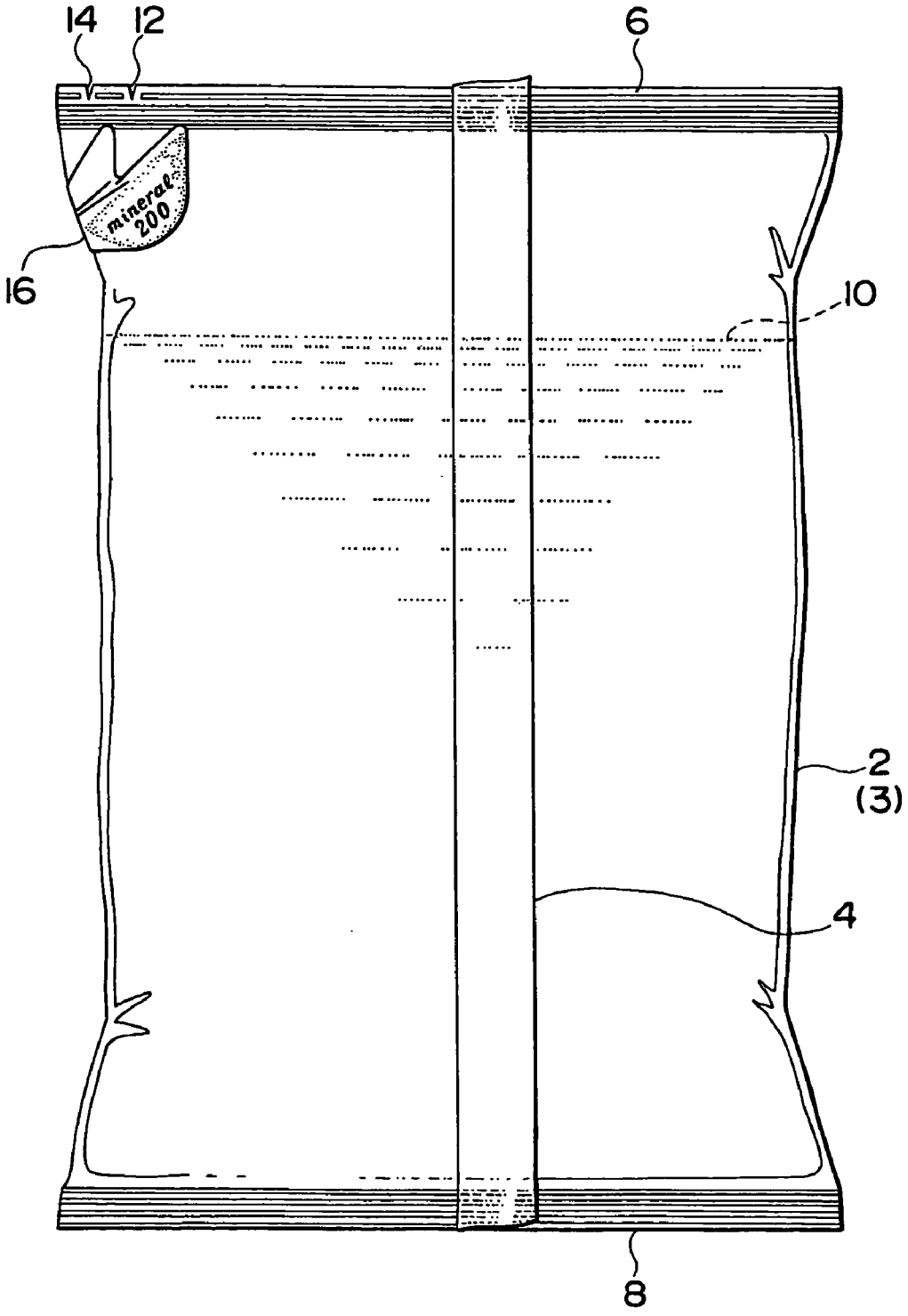
FIG. 1 is a plan view showing an embodiment of a flexible container and a liquid which is sealed in the flexible container.
Figure 2:
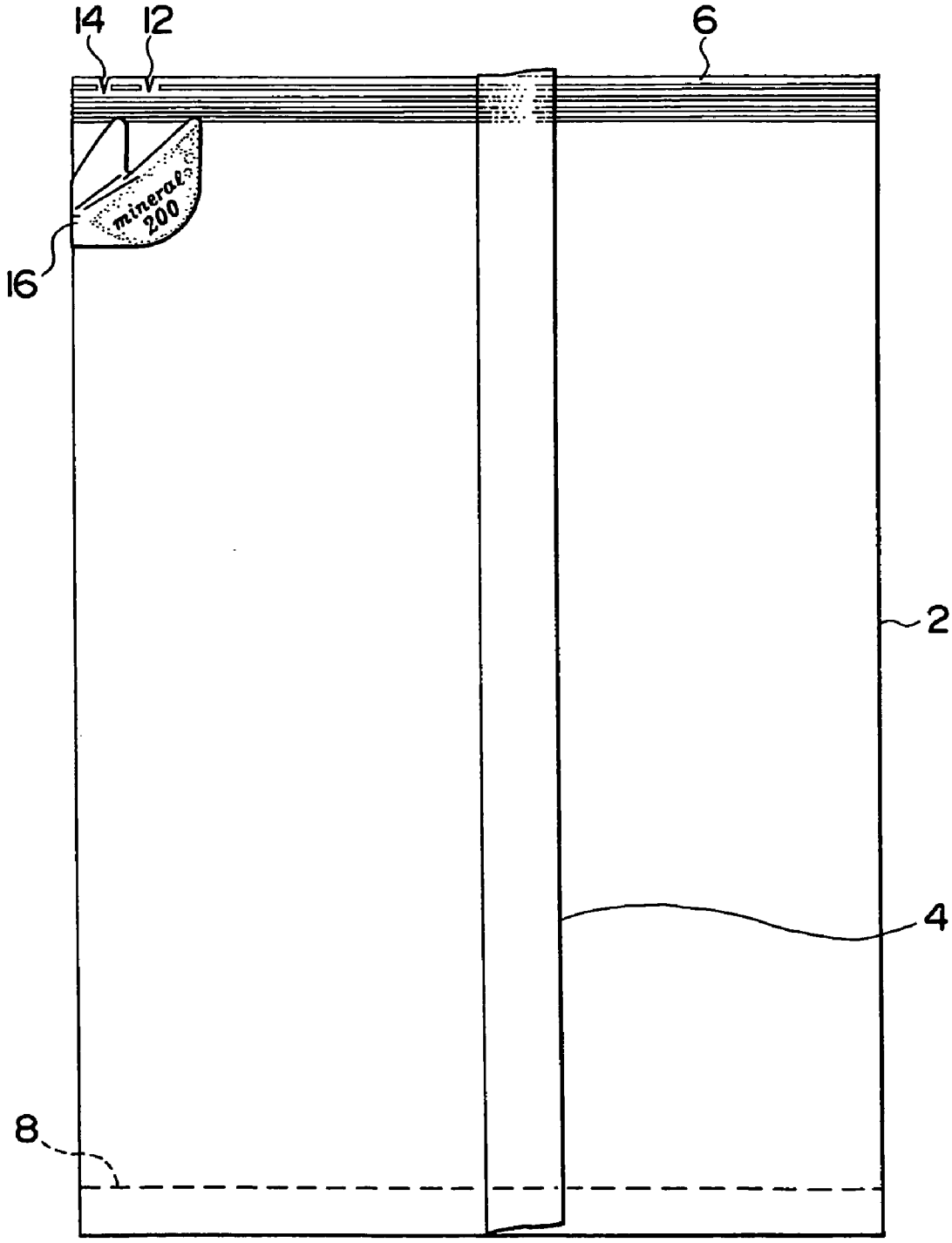
FIG. 2 is a plan view of a flexible container before liquid is enclosed in the flexible container.

FIG. 1 and FIG. 2 show a first embodiment of a flexible container of the invention, wherein FIG. 1 shows a flexible container in which water is enclosed and FIG. 2 is a flexible container before water is enclosed. The flexible container has a holding part 2 for enclosing drinking water, a liquid and so forth therein as an contents, and it is formed of a flexible material 3 having a sheet shape such as a synthetic resin film and so forth. According to this embodiment, there are formed a center seal part 4 serving as means for sealing the holding part 2 in a longitudinal direction, and a top seal part 6 and a bottom seal part 8 for sealing upper and lower sides of the holding part 2 and directed in a direction orthogonal to the center seal part 4. That is, the holding part 2 forms a sealed space sealed by these three seal parts 4, 6, 8, and water 10 is enclosed inside the holding part 2 according to the embodiment. FIG. 2 shows the holding part 2 before water 10 is enclosed in the holding part 2, in the case where the bottom seal part 8 is not formed, wherein the holding part 2 is sealed by the bottom seal part 8 after water 10 is enclosed in the holding part 2.

According to the embodiment, the flexible material 3 employs a lamination film formed by nylon, ethylene-vinylalcohol resin and polyethylene, and a lamination film of nylon, polyethylene terephthalate coated with aluminum oxide and polyethylene, and so forth serving as a material capable of enclosing water 10 and so forth as contents, and can prevent an odor from adhering to water 10 and so forth as the contents, and also can be opened upon reception of suitable tearing forth applied thereto.

Plural cuts 12, 14 are formed on one corner of the top seal part 6, and a seal-breaking guide 16 is attached to the holding part 2 while bridging over front and back faces of the holding part 2 for guiding tearing direction of the top seal part 6 and a part of the holding part 2 when the holding part 2 is opened through the cuts 12, 14. The cuts 12, 14 correspond to shapes of openings of the holding part 2 when the holding part 2 is opened, and they are selectively used such that the cut 12 is used for forming a large opening while the cut 14 is used for forming a small opening. Accordingly, the water 10 enclosed in the flexible container is commercialized as a unit of the flexible container in the same way as solid good although it is fluid, and it can be carried and kept with ease, and it is very convenient such that it is used when the holding part 2 is selectively opened through the cuts 12, 14.

The seal-breaking guide 16 is formed of a synthetic resin sheet having a high rigidity in a thickness substantially the same as the flexible material 3 forming the holding part 2, and can be configured by, for example, polyethylene terephthalate. If the seal-breaking guide 16 is configured by a transparent or by the same color as the holding part 2, it can be integrated with the holding part 2. The flexible material 3 on which the seal-breaking guide 16 is laminated is enforced by the seal-breaking guide 16 at the laminating portion, and hence it may be formed of a material which is thinner than the flexible material 3 or by a material which is thicker than the flexible material 3.

Figure 3:
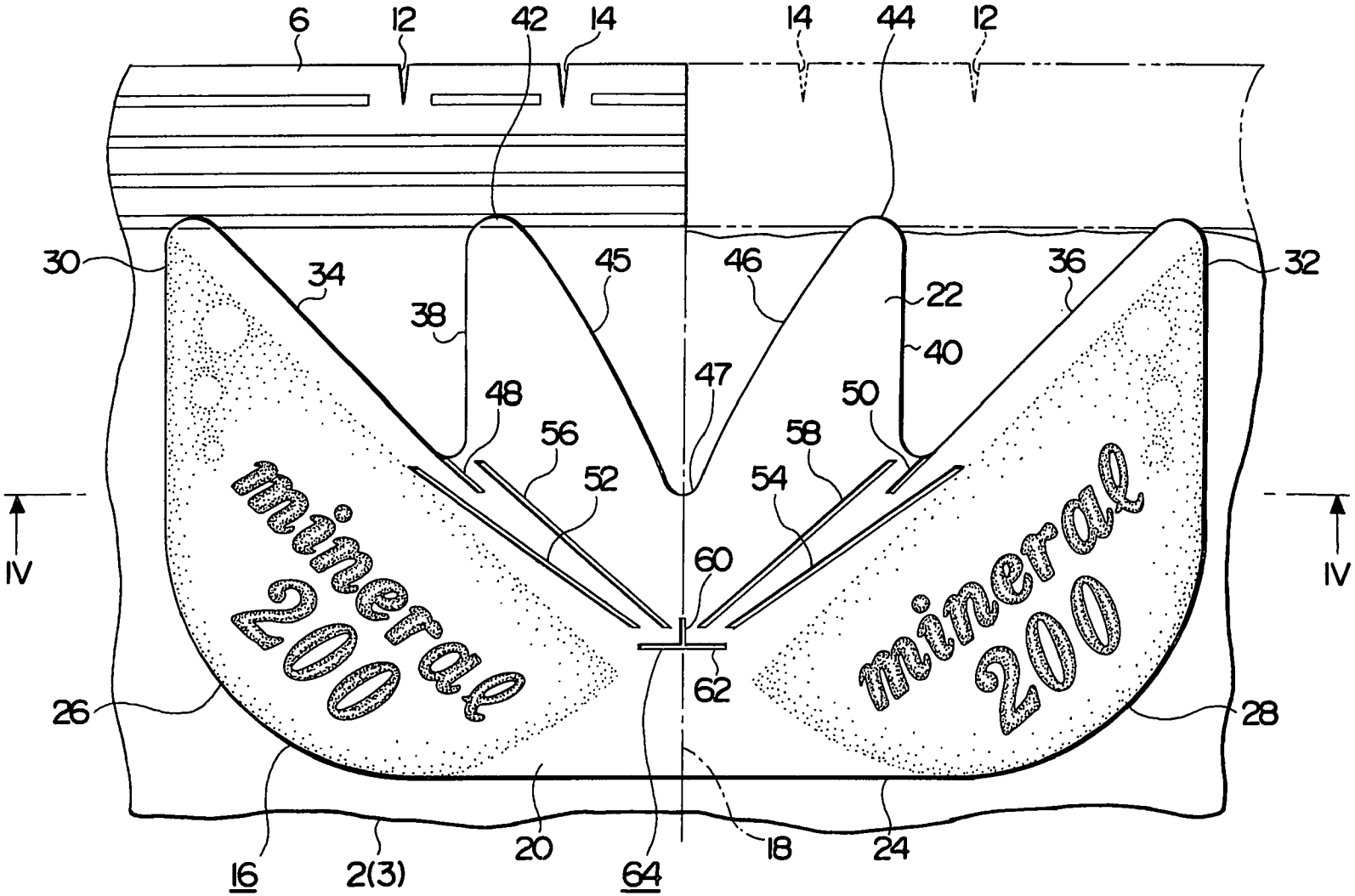
FIG. 3 is a plan view of a first embodiment of a seal-breaking guide of the flexible container of the invention.

If the seal-breaking guide 16 is exploded together with a part of the holding part 2 which is slit at the top seal part 6, it is illustrated, for example, as shown in FIG. 3. The seal-breaking guide 16 is a guide part for guiding a direction of tearing from the cuts 12, 14 toward the holding part 2, and serves as means for reinforcing an opening portion of the holding part 2. According to the embodiment, there are formed a first reinforcing part 20 and a second reinforcing part 22 which are symmetrical respectively about a ridge line 18 of the holding part 2. The first reinforcing part 20 comprises a linear horizontal edge part 24 which bridges over the ridge line 18 and circular outer edge parts 26, 28 for preventing it from exfoliating when it contacts an external portion, and a pair of triangular protrusion parts 30, 32 are formed at the right and left thereof so as to be integrated with the top seal part. That is, circular tip ends of the protrusion parts 30, 32 are overlaid on the top seal and subjected to thermal compression, and integrated with the top seal part 6.

First inclined edge parts 34, 36 are formed opposite to the protrusion parts 30, 32 for allowing a tearing stress to escape toward the ridge line 18 and guide the tearing stress therealong, and the inclined edge parts 34, 36 are formed in a salient shape relative to the horizontal edge part 24, e.g, at an inclined angle of about 45 degrees, and each inclined length thereof is set at about a half of the distance ranging from each apex of the protrusion parts 30, 32 to the ridge line 18. The reinforcing part 22 is formed within the interval between the inclined edge parts 34, 36, and there are formed vertical edge parts 38, 40 and protrusion parts 42, 44 at the left and right sides of the reinforcing part 22, and second inclined edge parts 45, 46 forming a V-shaped recess while interposing the ridge line 18, and a terminal end recess 47 forming a curved edge at the center side between the second inclined edge parts 45, 46. Each height of the protrusion parts 42, 44 serving as end edges of the second inclined edge parts 45, 46 is set to be the same as each height of the protrusion parts 30, 32 of the first reinforcing part 20 side, and the protrusion parts 42, 44 are subjected to a thermal compression when the top seal part 6 is formed and they are overlaid on the top seal part 6 and integrated therewith.

Short first slits 48, 50 are formed between the reinforcing part 20 and reinforcing part 22 toward the ridge line 18 by extending the inclined edge parts 34, 36 while second linear slits 52, 54 are formed under the slits 48, 50 in a direction from the portion close to the inclined edge parts 34, 36 toward the ridge line 18, and also a third linear slit 56 is provided at the slit 52 side while spaced from the slit 52, and likewise, a linear other third slit 58 is formed at the slit 54 side while spaced from the slit 54 toward the ridge line 18. The slits 52, 56 and the slits 54, 58 are spaced at a predetermined angular interval which are slightly narrowed therebetween toward the ridge line 18, and the end parts thereof at the ridge line 18 side are set at the same position from the horizontal edge part 24. That is, imaginary lines connecting the end parts of the slits 52, 56 and the slits 54, 58 are parallel with the horizontal edge part 24. There is formed a center slit 64 serving as an inversed T-shaped fourth slit having a horizontal part 62 orthogonal to the vertical part 60 which is provided along the ridge line 18 between the slits 56, 58 at the end parts thereof.

Figure 4A:
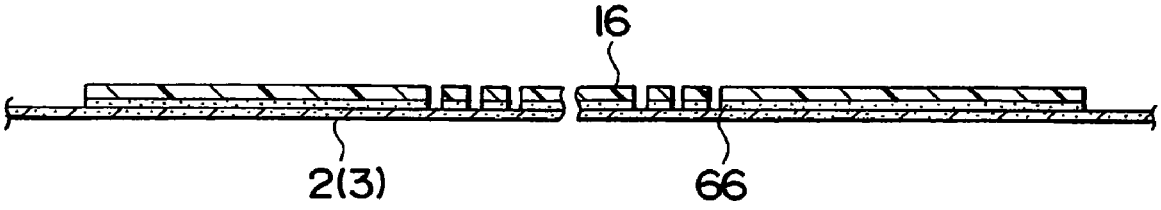
FIG. 4(A) is a sectional view of the seal-breaking guide of the flexible container taken along IV-IV in FIGS. 3 and 4(B) is a partial enlarged sectional view thereof.
Figure 4B:
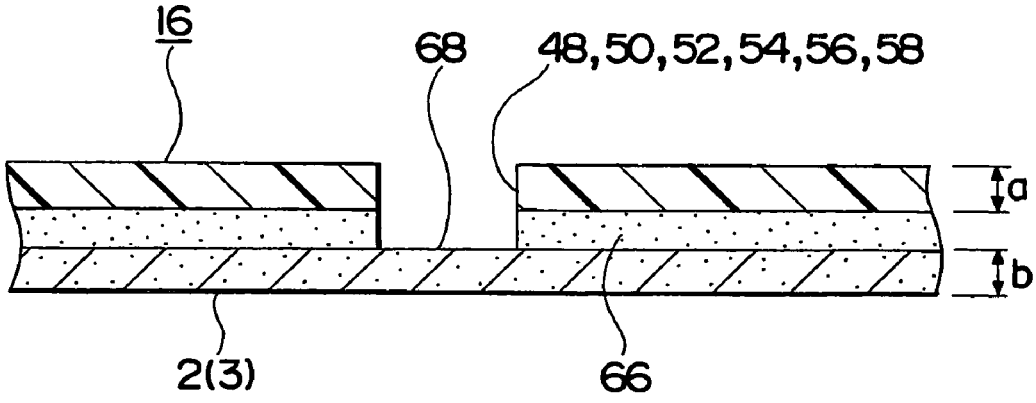

If the seal-breaking guide 16 is taken, for example, along the line IV-IV in FIG. 3, the cut end faces form, for example, a sectional configuration shown in FIG. 4(A), and FIG. 4(B) shows its enlarged sections. That is, the seal-breaking guide 16 is brought into contact with and fixed onto the flexible material 3 constituting the holding part 2 by fixing means, for example, an adhesive 66. The holding part 2 to which the seal-breaking guide 16 is adhered is partially enforced by the reinforcing parts 20, 22, and the flexible material 3 of the holding part 2 is exposed from the seal-breaking guide 16 at the portions where each of the slits 48 to 58 and the center slit 64 respectively formed on the reinforcing parts 20, 22, thereby constituting a non-reinforcing part 68. According to the embodiment, since the seal-breaking guide 16 is formed by subjecting a high rigid synthetic resin to die slitting process and so forth, respective edge parts such as each of the slits 48, 50, 52, 54, 56, 58, each of the inclined edge parts 34, 36, 45, 46, each of the vertical edge parts 38, 40, each of the protrusion parts 30, 32, 42, 44 and so forth constitute an edge part vertically rising from the flexible material 3. A thickness a of the seal-breaking guide 16 is set at substantially the same thickness b of the flexible material 3, for example, supposing that the thickness b of the material of the flexible material 3 ranges from 50 to 100 μm, the thickness a of the seal-breaking guide 16 ranges from about 50 to 100 μm.

Described next are a method of forming the flexible container provided with the seal-breaking guide 16 and a method of enclosing the liquid in the flexible container.

Figure 5A:
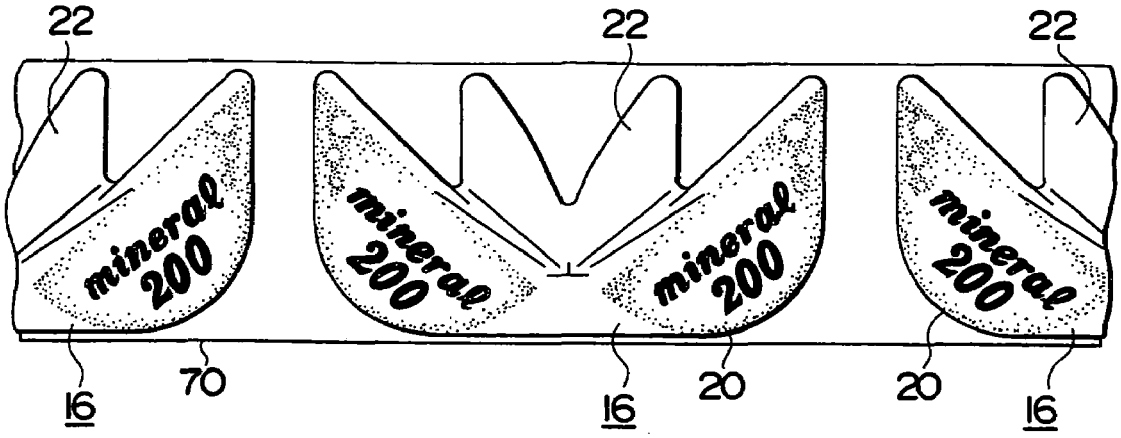
FIGS. 5(A) and 5(B) are views showing shapes of the seal-breaking guide, adhering process of the seal-breaking guide to a flexible material serving as a method of forming the flexible container and a method of enclosing liquid in the flexible container of the invention.

As shown in FIG. 5(A), the guides 16 are formed on a continuous belt-shaped board 70 at a predetermined interval and an adhesive 66 for bonding the seal-breaking guides 16 to the flexible material 3 is pasted on the back side of the seal-breaking guides 16. The method of forming the seal-breaking guides 16 comprises, for example, bonding a synthetic resin sheet to the back face of which the adhesive 66 is adhered onto the belt-shaped board 70, then forming the seal-breaking guides 16 at a predetermined interval by die slitting process, thereafter removing the synthetic resin sheet other than the seal-breaking guides 16.

Figure 5B:
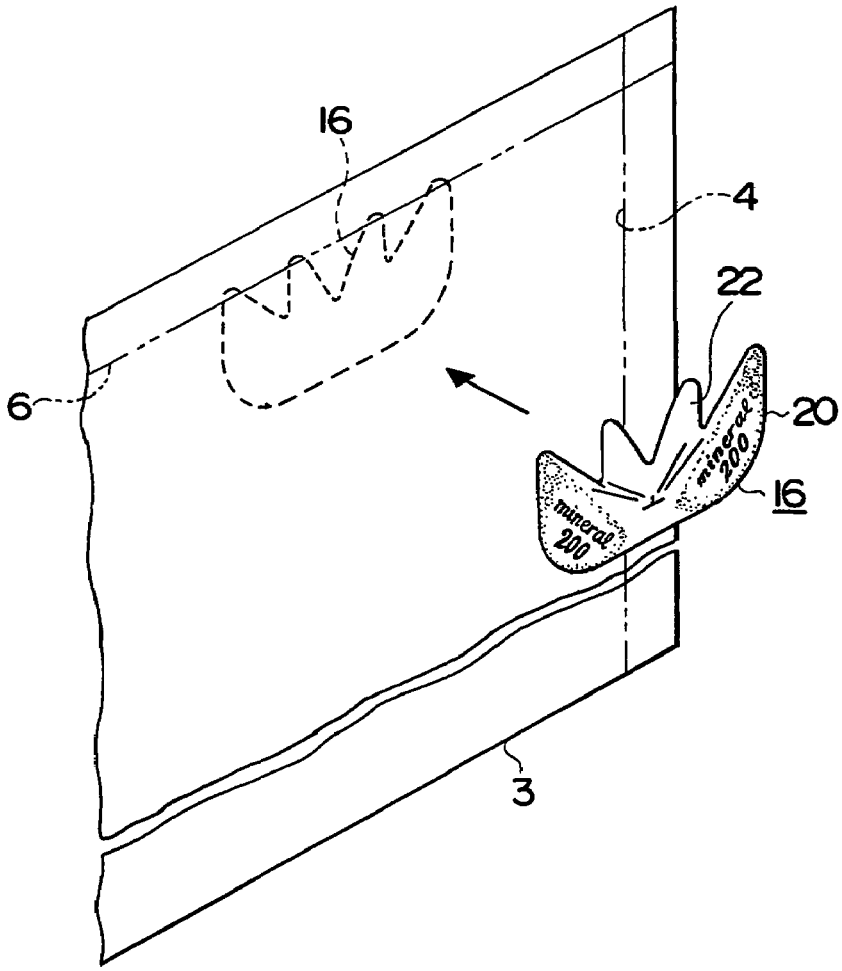

The seal-breaking guides 16 on the board 70 are sucked toward a robot arm side, not shown, to exfoliating them from the board 70 to hold them then they are bonded onto the belt-shaped flexible material 3 at a predetermined position shown in FIG. 5(B). The positions of the seal-breaking guides 16 relative to the flexible material 3 are set with high accuracy based on each position where the center seal part 4 and the top seal part 6 are formed.

Figure 6A:
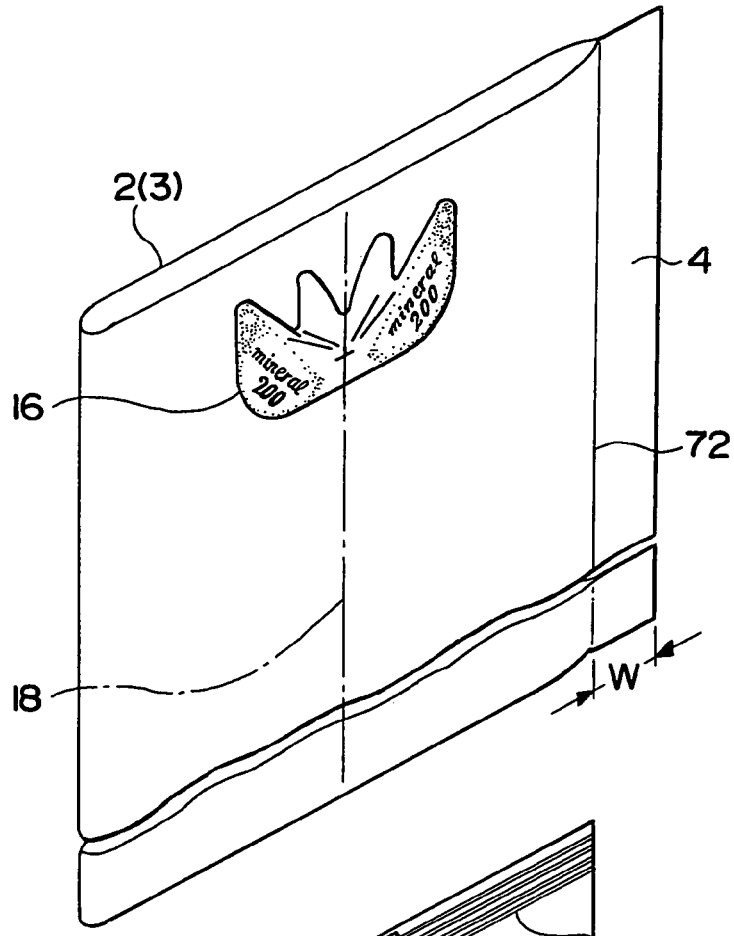
FIGS. 6(A) and 6(B) are perspective views showing a forming process of a center seal part and top seal part serving as a method of forming the flexible container and a method of enclosing liquid in the flexible container of the invention.

The flexible material 3 onto which the seal-breaking guide 16 is bonded is, as shown in FIG. 6(A), subjected to a seal processing at the center seal part 4, so that a cylindrical holding part 2 is formed by the single flexible material 3. A width W of the center seal part 4 and an edge part 72 thereof are set such that the center of the seal-breaking guide 16 is positioned at the ridge line 18 of the holding part 2.

Figure 6B:
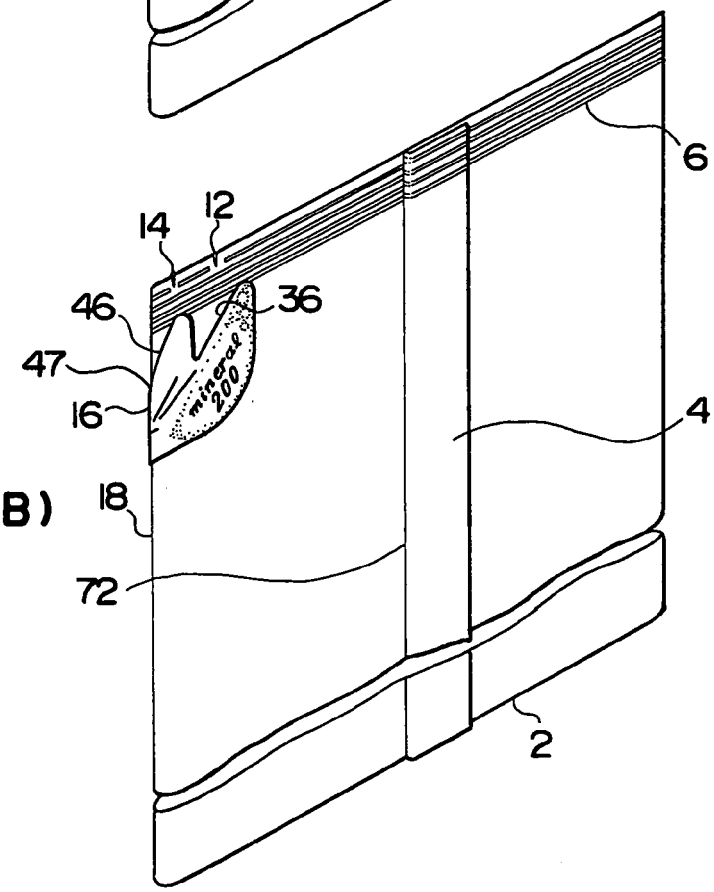

The holding part 2 to which the seal-breaking guide 16 is attached is configured, for example, as shown in FIG. 6(B), such that the edge part 72 of the center seal part 4 is set at the center of the holding part 2, and a center line of the seal-breaking guide 16 serves as the ridge line 18, then the center seal part 4 is bent in one direction and overlaid on the holding part 2, thereafter the top seal part 6 is formed at the upper side of the holding part 2, which is subjected to a sealing process. That is, if the inner side of the flexible material 3 constituting the holding part 2 is, for example, made of polyethylene which can be subjected to thermal compression, it can be easily subjected to compression by heat compression by a sealing process device, not shown, and the compression process can be effected with high accuracy at a suitable temperature, a pressure application force and time. The cut 12 is formed at the seal-breaking guide 16 side of the top seal part 6 at a predetermined position of the inclined edge parts 34, 36 and the cut 14 is formed at a predetermined position of the inclined edge parts 45, 46 side in a direction orthogonal to the top seal part 6.

Although the end edge recess 47 of the inclined edge parts 45, 46 of the seal-breaking guide 16 is overlapped on the ridge line 18 of the holding part 2 according to the embodiment, the end edge recess 47 which is curved by the inclined edge parts 45, 46 of the seal-breaking guide 16 forms a gentle edge part so that the inclined edge parts 45, 46 of the seal-breaking guide 16 is adapted to the ridge line 18 of the holding part 2 to be integrated therewith, and the edge part thereof does not form an extreme protrusion, and hence it is not hindered in handling thereof.

The holding part 2 which is closed at two sections of the center seal part 4 and the top seal part 6 constitutes the flexible container which is opened due to non-formation of the bottom seal part 8, as shown in FIG. 2. After the water 10 is charged in the holding part 2 by a predetermined amount with charging means, not shown, while an opening side of the flexible container is directed upward, the holding part 2 is sealed at the bottom seal part 8, thereby completing the charging of liquid and sealing process.

Figure 13:
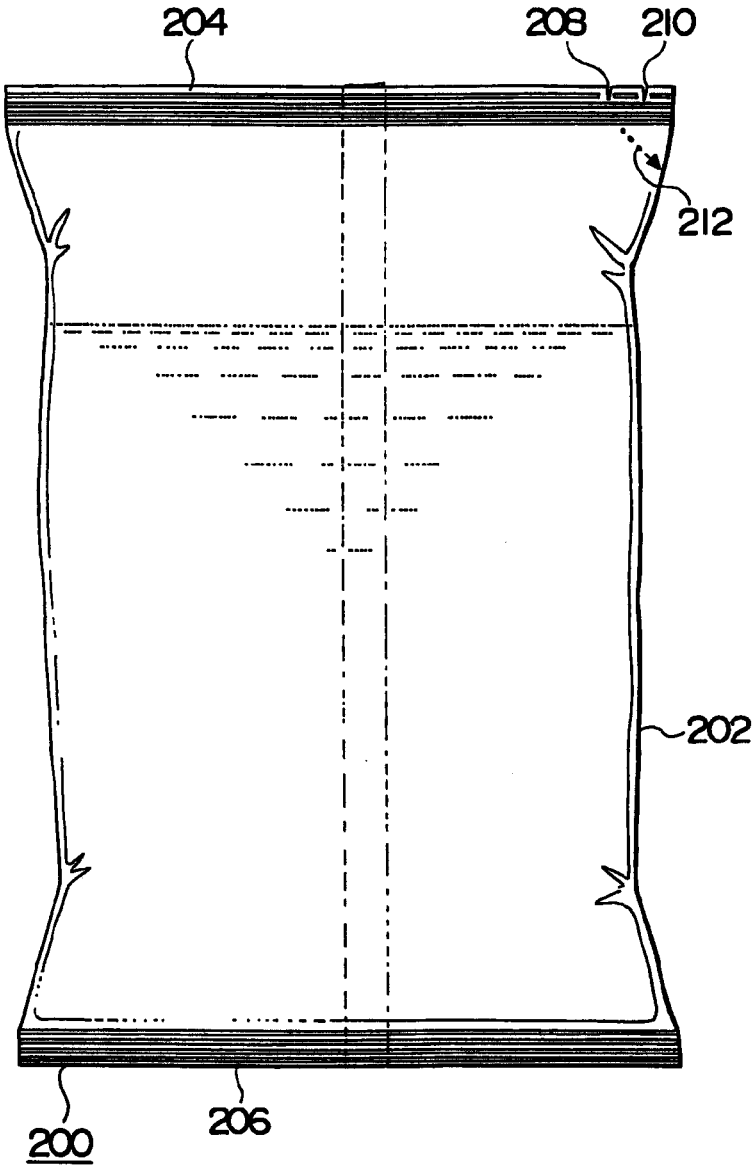
FIG. 13 PRIOR ART
FIG. 13 is a plan view of a conventional flexible container.
Figure 14:
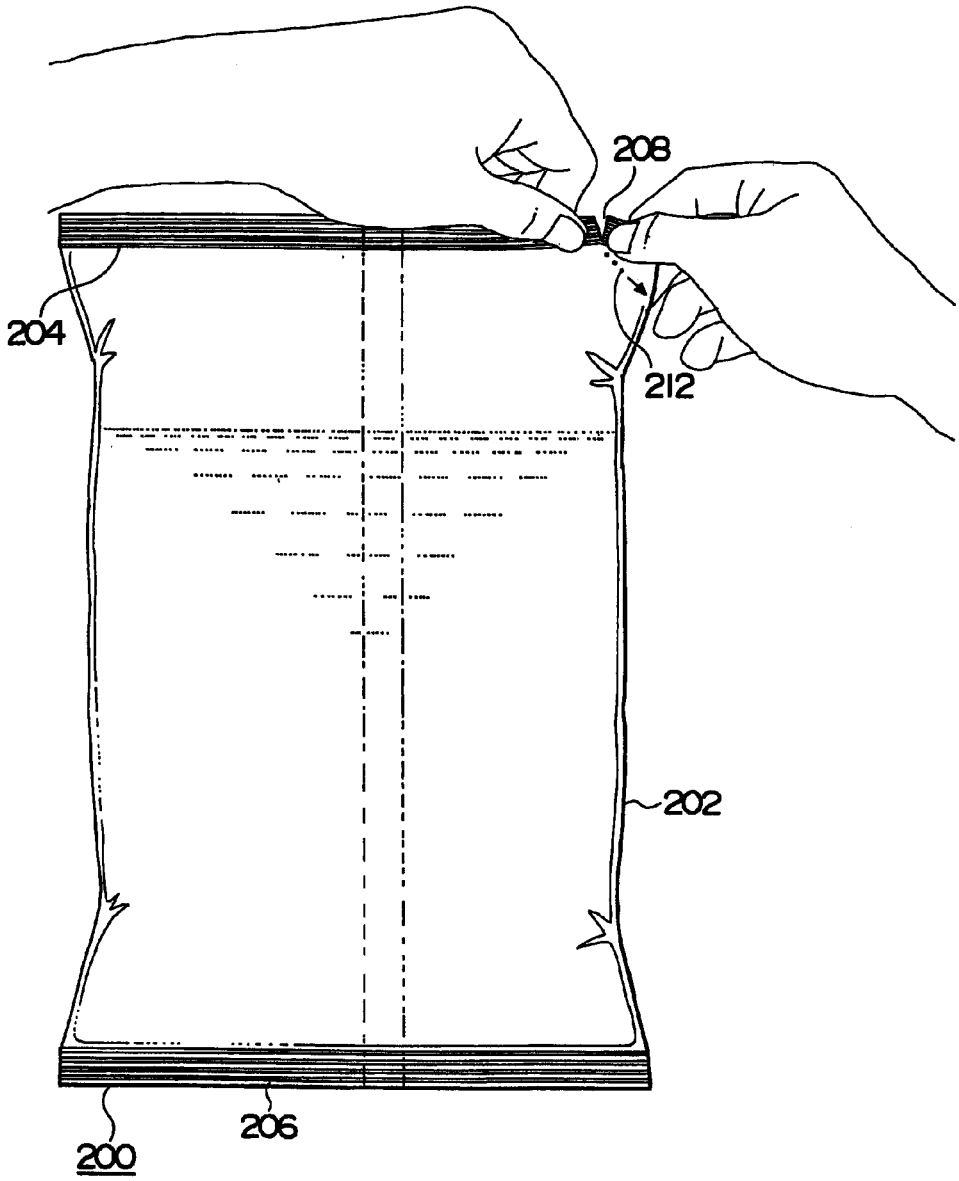
FIG. 14 PRIOR ART
FIG. 14 is a view showing the opening of the conventional flexible container.
Figure 15:
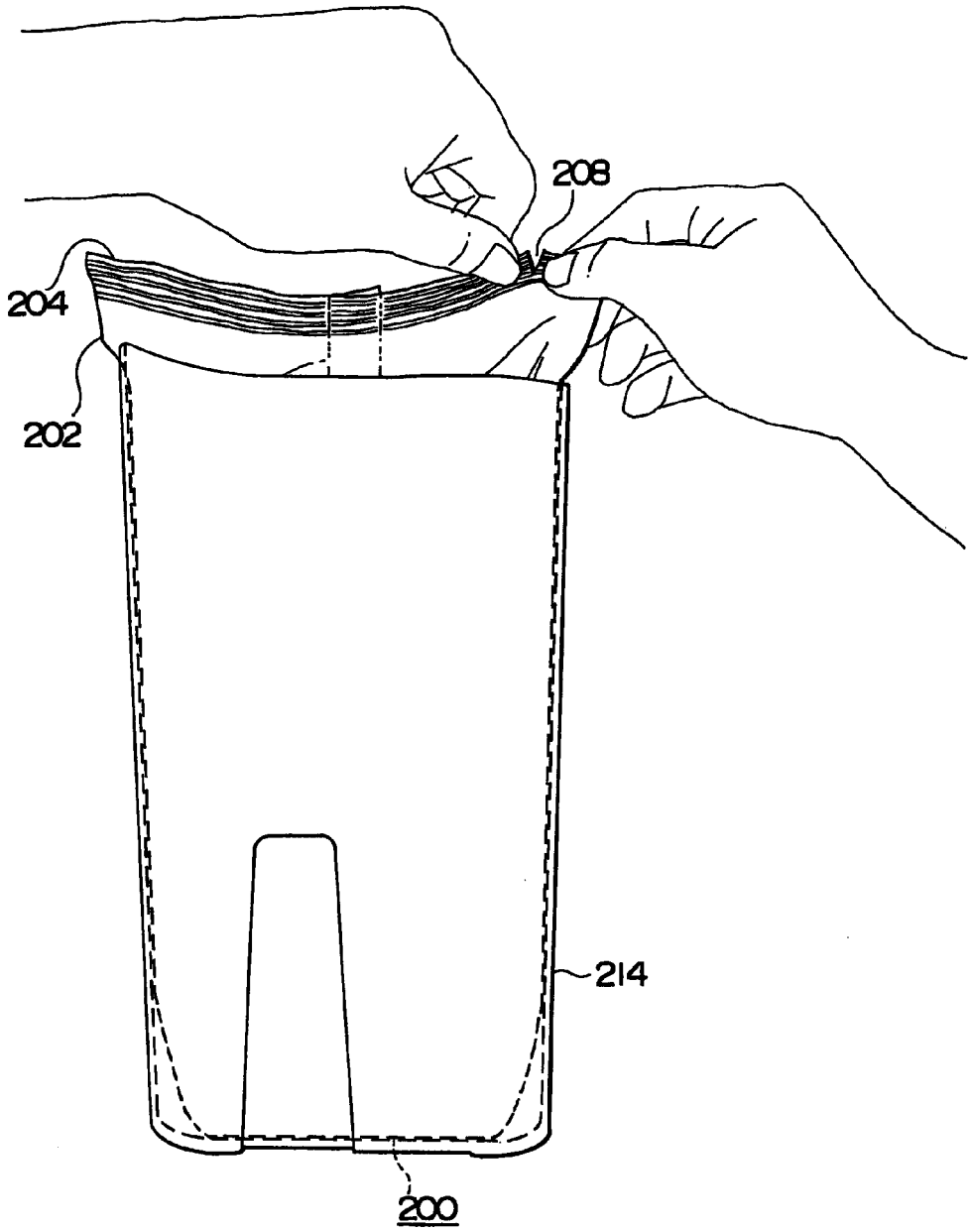
FIG. 15 PRIOR ART
FIG. 15 is a view showing the opening of another conventional flexible container.
Figure 16A:
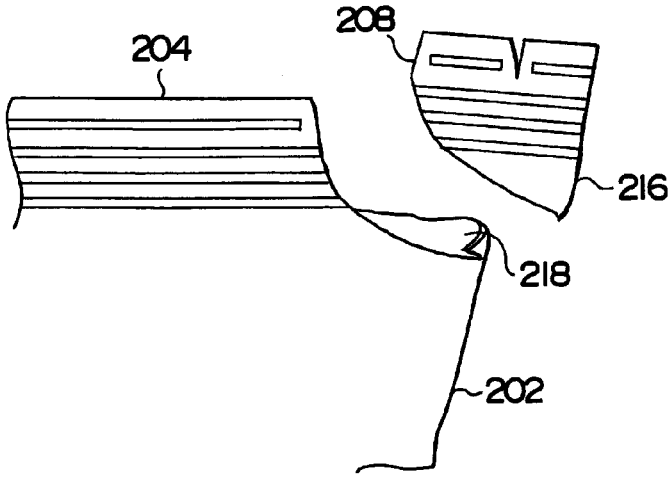
FIG. 16(A) PRIOR ART
FIGS. 16(A), 16(B) and 16(C) are views showing various states of opening formed by opening the conventional flexible container.
Figure 16B:
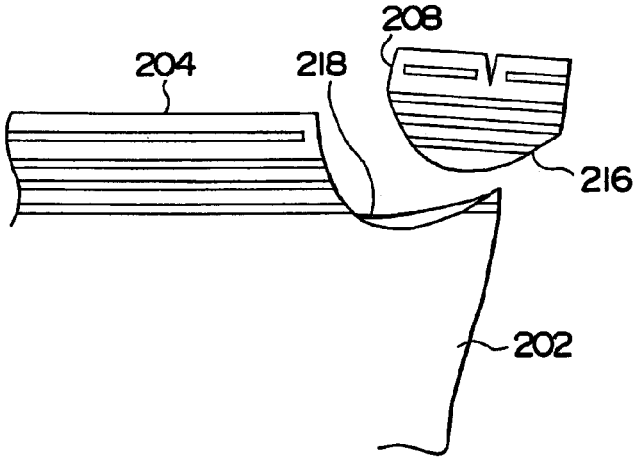
FIG. 16(B) PRIOR ART
Figure 16C:
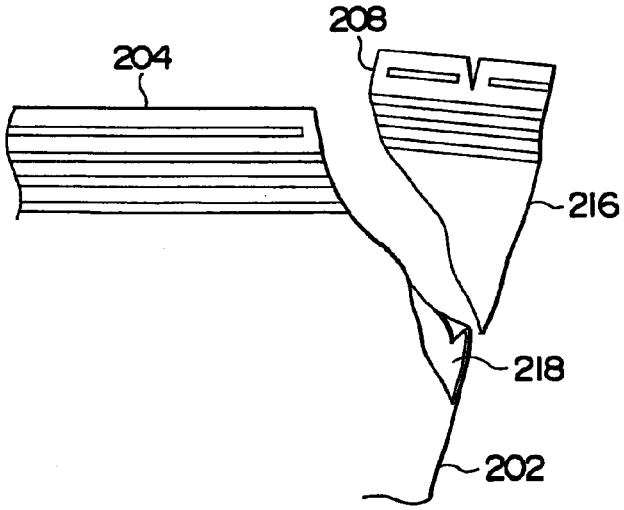
FIG. 16(C) PRIOR ART

According to the flexible container to which the seal-breaking guide 16 is provided, the top seal part 6 and the holding part 2 are torn through the cut 12 or the cut 14 as shown in FIG. 13 and FIG. 14 by the same opening process as the prior art so that the holding part 2 can be easily opened, thereby taking out the water 10 serving as the contents in the holding part 2.

Figure 7A:
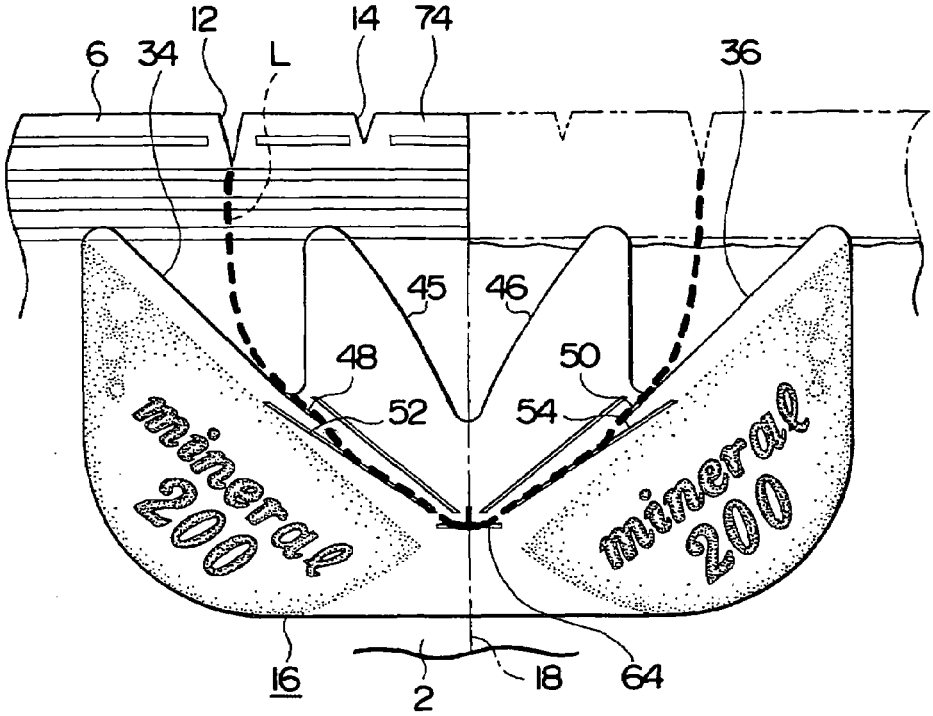
FIGS. 7(A) and 7(B) are views showing tearing guiding operation of the seal-breaking guides.

Described next is the operation of the seal-breaking guide 16 when the holding part 2 is opened. When a tearing force is applied to the cut 12, there generates a breakage, for example, as shown in a broken line L in FIG. 7(A), so that a breakage piece 74 which is a part of the flexible container, is removed to form an opening in the holding part 2. In this case, although a tearing stress acts on two faces of the top seal part 6 and the holding part 2, the breakage generated by this stress is blocked by the inclined edge parts 34, 36, and guided and introduced toward the slits 48, 50 side and then influences on the slits 52, 54 to move toward the center slit 64, thereby forming a symmetrical breakage piece 74. As a result, the openings formed in the holding part 2 form ideal opening configurations which are symmetrical about the ridge line 18 in the same shape as the breakage piece 74.

In this case, the seal-breaking guide 16 is formed by subjecting high rigid synthetic sheet to a die slitting process and so forth, so that each of the edge part such as each of the slits 48, 50, 52, 54, 56, 58, each of the inclined edge parts 34, 36, 45, 46, each of the vertical edge parts 38, 40, each of the protrusion parts 42, 44 and so forth, for example, constitute an edge part vertically rising from the flexible material 3, as shown in FIG. 4(B), and the flexible material 3 is reinforced by the seal-breaking guide 16, so that the tearing force applied to the holding part 2 is shut out at the edge part side of the seal-breaking guide 16, and it is guided in inclined directions of the inclined edge parts 34, 36, and the torn part is guided between the slits 52, 56 and intruded between the slits 54, 58, and hence the holding part 2 is broken at the inversed T-shaped center slit 64 at the ridge line 18 side to open the holding part 2.

Figure 7B:
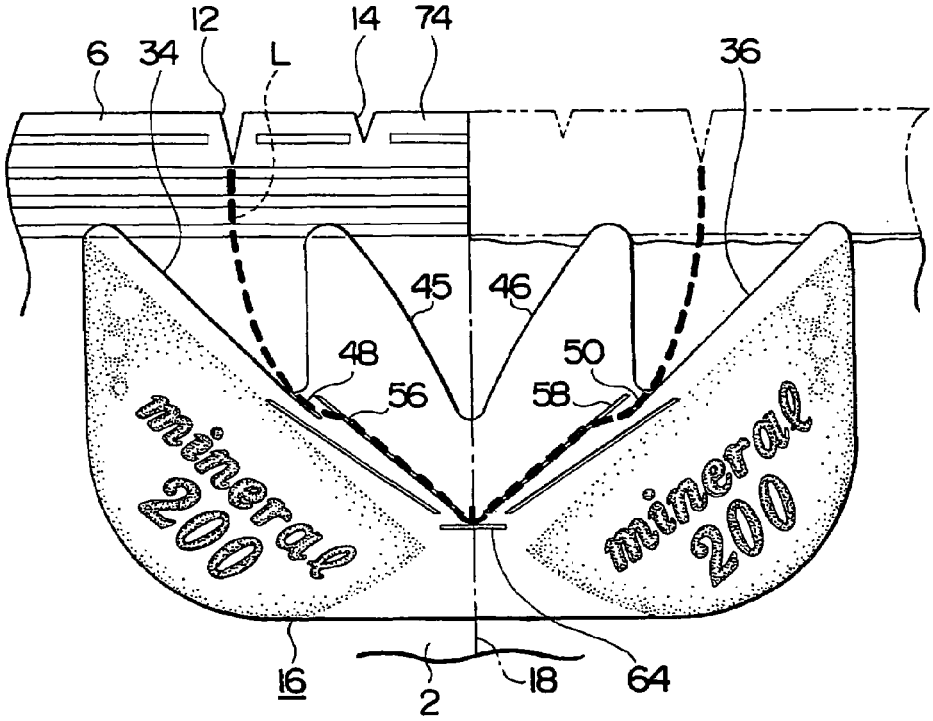

Depending on the tearing force applied to the cut 12, the breakage shown in a broken line L in FIG. 7(B) is generated, so that the breakage piece 74 serving as a part of the flexible container is removed to form the opening in the holding part 2. Since a uniform tearing stress acts on both sides of the top seal part 6 and holding part 2 also in this case, the breakage generated by this stress is blocked by the inclined edge parts 34, 36, then guided toward the first slits 48, 50, and influences on the slits 56, 58 then moves to the center slit 64, thereby forming the symmetrical breakage piece 74. As a result, the opening formed in the holding part 2 forms an ideal opening configuration which is symmetrical about the ridge line 18 in the same shape as the breakage piece 74.

Figure 8A:
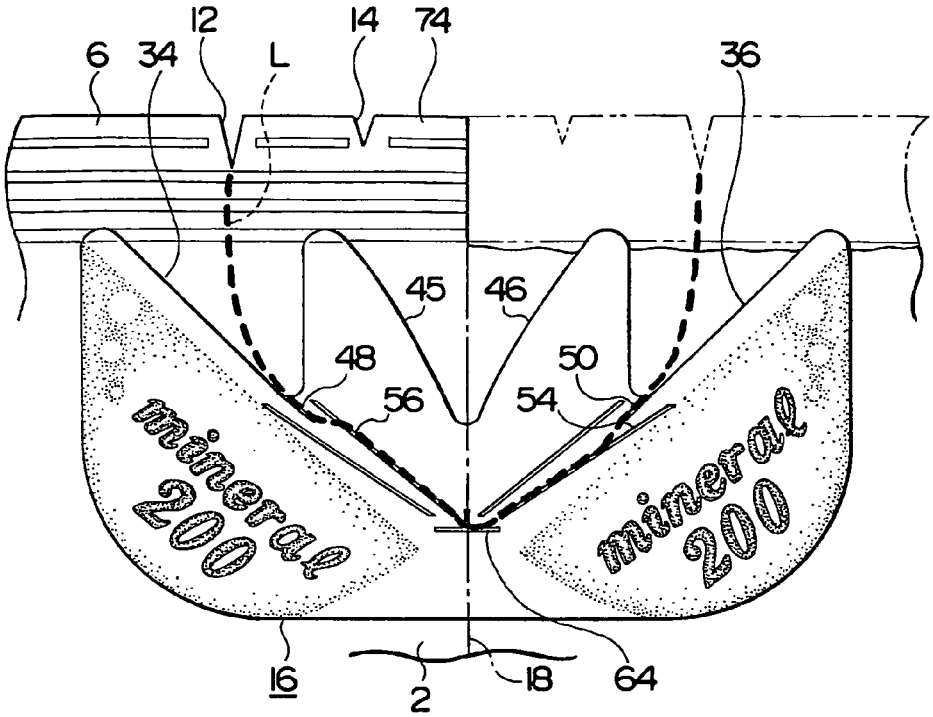
FIGS. 8(A) and 8(B) are views showing another tearing guiding operation of the seal-breaking guide.

Depending on a tearing force applied to the cut 12, the breakage shown in a broken L in FIG. 8(A) is generated, so that the breakage piece 74 serving as a part of the flexible container is removed to form the opening in the holding part 2. In this case, a uniform tearing stress does not act on both sides of the top seal part 6 and holding part 2. That is, although the breakage generated by such a stress is blocked by the inclined edge parts 34, 36, and guided toward and introduced into the slits 48, 50, since the stress is not uniform, one of the breakage (left side in FIG. 8(A)) influences on the slit 56 to move to the center slit 64 while the other breakage (right side in FIG. 8(A)) influences on the slit 54 to move to the center slit 64. As a result, an asymmetrical breakage piece 74 is formed. In this case, the variation of the shape of the breakage piece 74 is very small because it is guided within an interval width of the slits 52, 56 and that of the slits 54, 58, so that the breakage piece 74 can be stated to be symmetrical. As a result, the opening formed in the holding part 2 becomes a substantial symmetrical opening configuration about the ridge line 18 like the shape of the breakage piece 74.

Figure 8B:
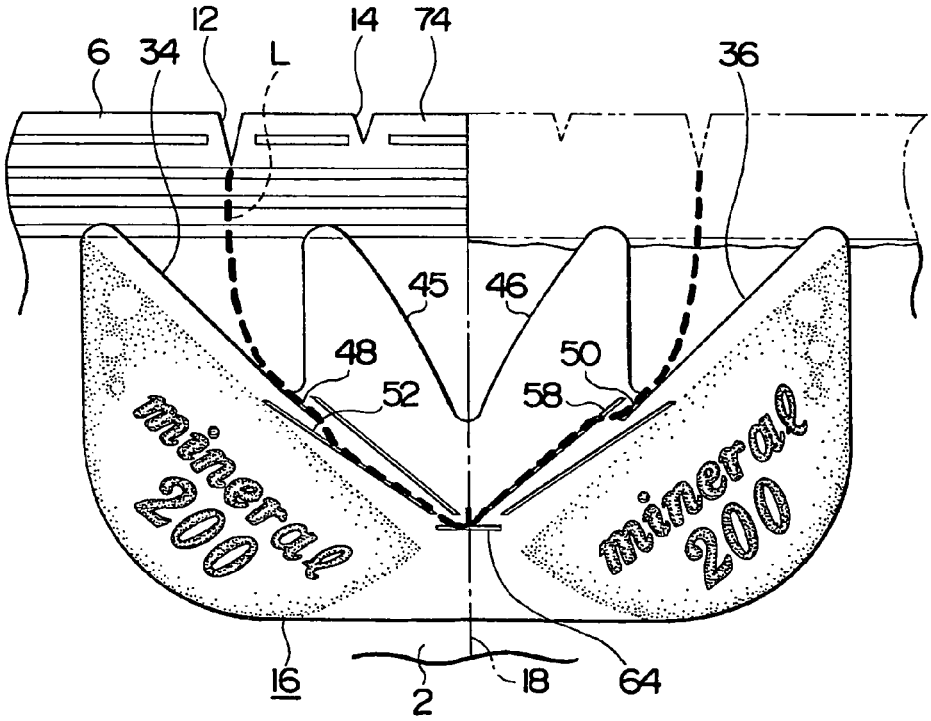

Depending on the tearing force applied to the cut 12, the breakage shown in a broken line L in FIG. 8(B) is generated, so that the breakage piece 74 serving as a part of the flexible container is removed to form the opening in the holding part 2. Also in this case, a uniform tearing stress does not act on both sides of the top seal part 6 and holding part 2. That is, although the breakage generated by such a stress is blocked by the inclined edge parts 34, 36, and guided toward and introduced into first slits 48, 50, since the stress is not uniform, one of the breakage (left side in FIG. 8(B)) influences on the slit 52 to move to the center slit 64 while the other breakage (right side in FIG. 8(B)) influences on the slit 58 to move to the center slit 64. As a result, an asymmetrical breakage piece 74 is formed. Also in this case, the variation of the shape of the breakage piece 74 is very small because it is restricted within an interval width of the slits 52, 56 and that of the slits 54, 58, so that the breakage piece 74 can be stated to be symmetrical. As a result, the opening formed in the holding part 2 becomes a substantial symmetrical opening configuration about the ridge line 18 like the shape of the breakage piece 74.

Figure 9:
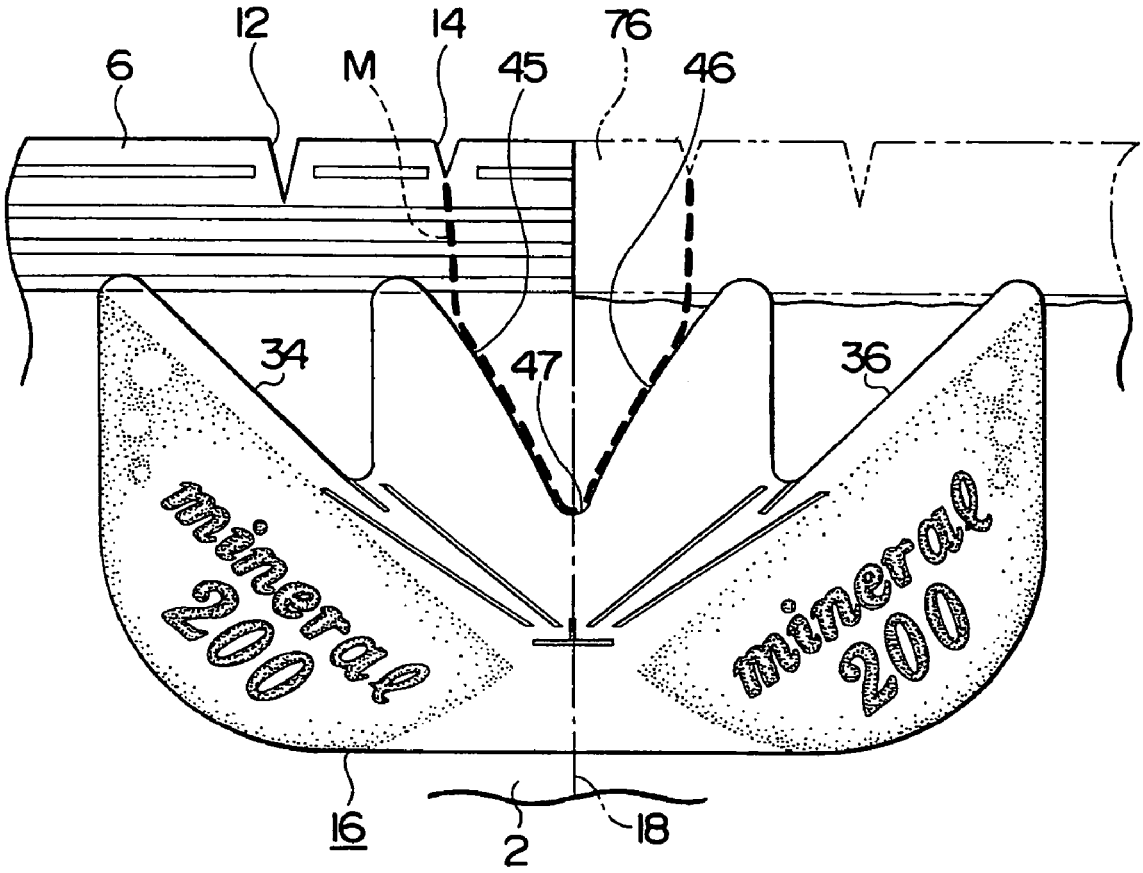
FIG. 9 is a view showing still another tearing guiding operation of the seal-breaking guide.

In the case where the top seal part 6 and holding part 2 are torn at the cut 14, a breakage is generated along the inclined edge parts 45, 46 as shown in a broken line M in FIG. 9, so that a breakage piece 76 serving as a part of the flexible container is removed, thereby forming an opening in the holding part 2. In this case, since the breakages are generated in a narrow width, they are prevented from the top seal part 6 by the inclined edge parts 45, 46, and guided toward the ridge line 18 by the inclined edge parts 45, 46, then collected in the end edge recess 47 so that the breakage piece 76 is removed from the top seal part 6 and holding part 2 to form the symmetrical opening in the holding part 2.

In the case where the holding part 2 is subjected to an opening process by the tearing force applied to the cuts 12, 14, directions of breaking and tearing are respectively guided in their operating directions along the seal-breaking guide 16, then they are guided toward the ridge line 18. Further, in the case where the holding part 2 is torn from the cut 12 side, and from the cut 14 side, the symmetrical or substantial symmetrical opening can be formed in the holding part 2. As a result, a uniform opening can be formed in the holding part 2 without error in opening even if any stress is applied thereto, so that the water 10 serving as contents can be easily taken out from the holding part 2.

Figure 17:
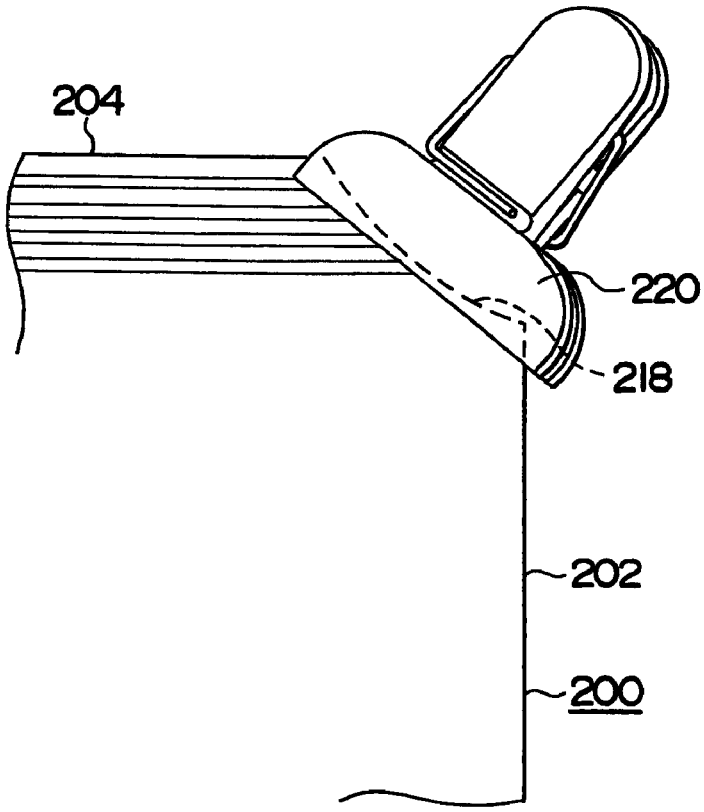
FIG. 17 PRIOR ART
FIG. 17 is a view showing a close contact state by clipping an opening formed by opening the conventional flexible container.

Further, if a part of the seal-breaking guide 16 serving as the opening of the holding part 2 is clamped by a closing member, for example, by a clip 220 shown in FIG. 17, the opening can be easily sealed. Even if the holding part 2 sealed by the clip 220 is cooled in a refrigerator, a close contact state of the opening can be released by a restoring force of the seal-breaking guide 16 if the clip 220 is removed, thereby saving the opening operation of the opening for releasing the sealing of the opening or preventing the error in pouring water into the holding part 2 in the close contact state.

Second Embodiment

Figure 10:
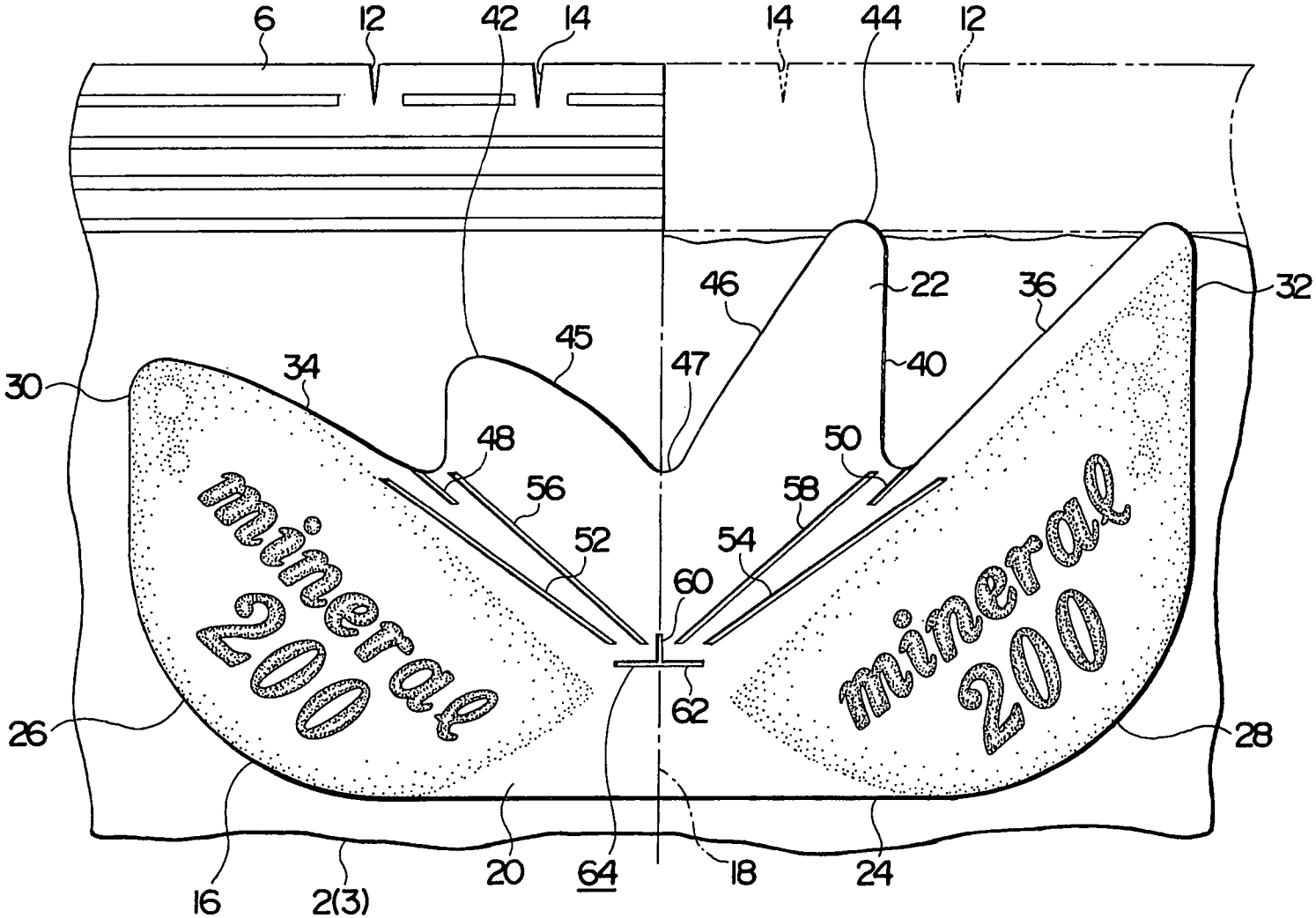
FIG. 10 is a plan view showing a second embodiment of a seal-breaking guide of a flexible container of the invention.

Although the seal-breaking guide 16 is formed in the symmetrical shape according to the first embodiment, in the case where a material constituting a seal-breaking guide 16 is thicker than a flexible material 3 constituting a holding part 2, it is possible that one of the protrusion parts 30, 42 of the seal-breaking guide 16 is prevented from being subjected thermal compression at a top seal part 6 and the load applied to the top seal part 6 when subjected to thermal compression may be reduced by forming the seal-breaking guide 16 in an asymmetrical shape like the second embodiment as shown in FIG. 10. That is, according to the seal-breaking guide 16, the height of the protrusion part 30 is lower than that of a protrusion part 32 and the height of the protrusion part 42 is lower than that of a protrusion part 44, and the inclined angle of the inclined edge part 34 is formed to be more gentle than that of an inclined edge part 36, and also, the inclined angle of an inclined edge part 45 is formed to be more gentle than that of an inclined edge part 46.

With such an arrangement, the top seal part 6 can be detached from the protrusion parts 30, 42, and the thermal compression of the top seal part 6 can be easily effected only the thermal compression is applied only onto the protrusion parts 32, 44. Particularly, when a thick material is employed by the seal-breaking guide 16 as a constituent material, a part of the seal-breaking guide 16 can be detached from the top seal part 6, thereby enhancing thermal compression property of the top seal part 6 to realize a high reliability sealing. Even with such a configuration of the second embodiment, a uniform opening can be formed by the seal-breaking guide 16 in the same manner as the first embodiment.

Third Embodiment

Figure 11:
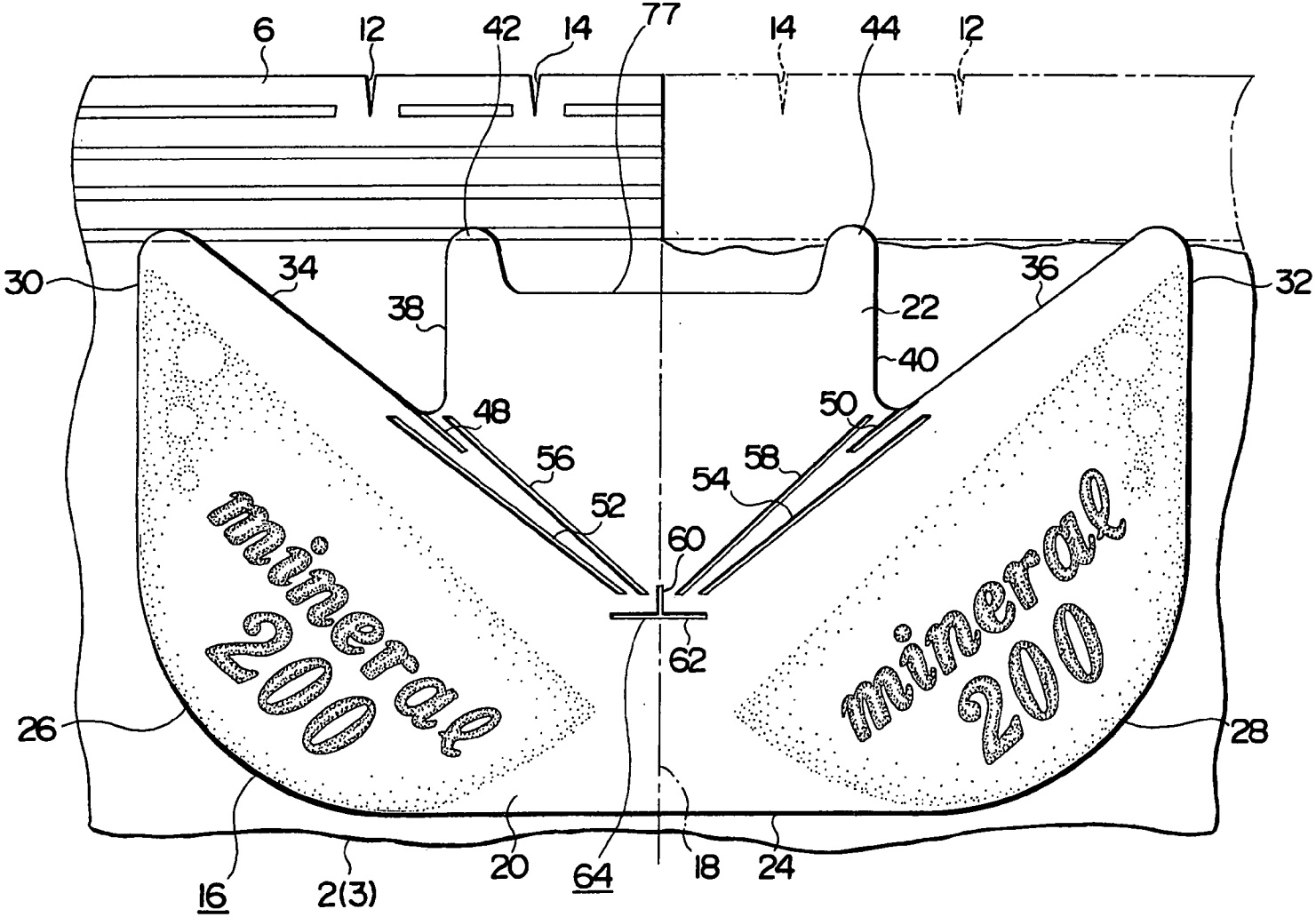
FIG. 11 is a plan view showing a third embodiment of a seal-breaking guide of a flexible container of the invention.

In the case where a material constituting the seal-breaking guide 16 is thinner than a flexible material 3 constituting a holding part 2, inclined edge parts 45, 46 are formed in a horizontal edge part 77, for example, as shown in FIG. 11 of the third embodiment, and protrusion parts 42, 44 are formed while sandwiching the horizontal edge part 77, whereby the protrusion parts 42, 44 may be clamped in a top seal part 6. Even with such a configuration of the third embodiment, a uniform opening can be formed by the seal-breaking guide 16 in the same manner as the first embodiment.

Fourth Embodiment

Figure 12:
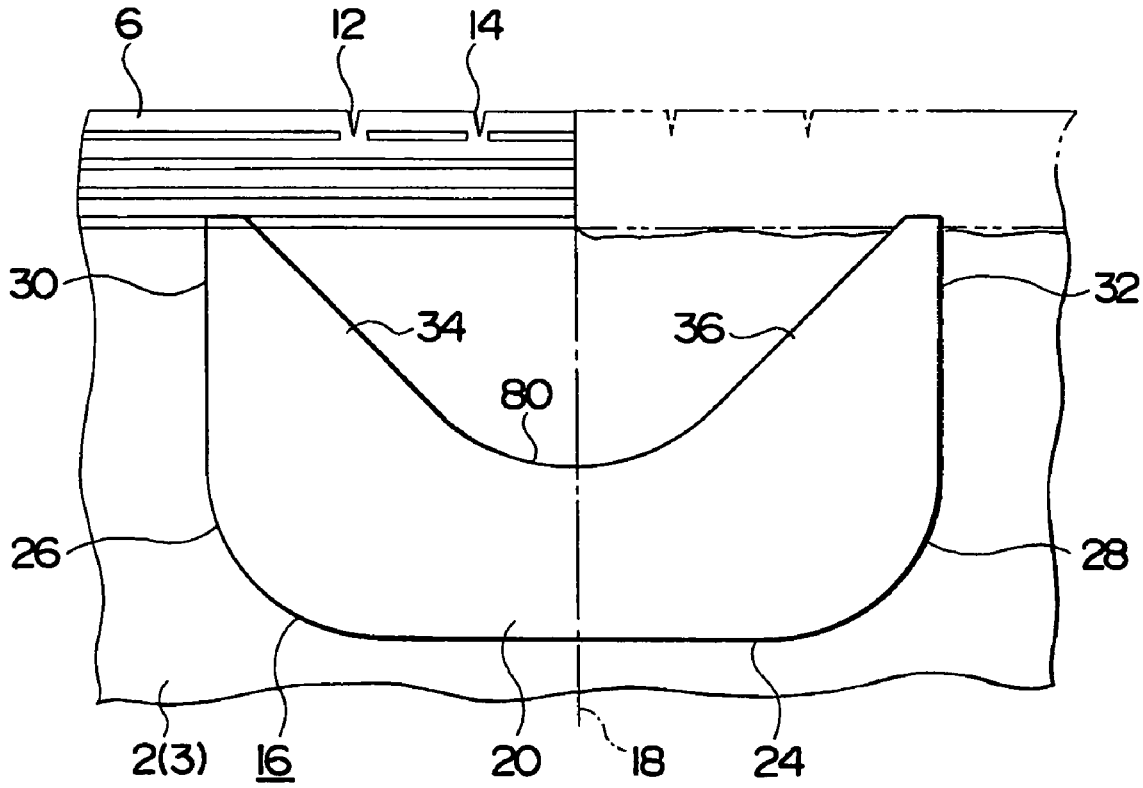
FIG. 12 is a plan view showing a fourth embodiment of a seal-breaking guide of a flexible container of the invention.

Further, a seal-breaking guide 16 may be constituted, for example, as shown in FIG. 12 of the fourth embodiment. A first reinforcing part 20 which is symmetrical about a ridge line 18 of a holding part 2 is formed according to the seal-breaking guide 16, and it includes circular peripheral edges 26, 28 so as to prevent exfoliation caused by the contact between a linear horizontal edge part 24 which extending over the ridge line 18 and an outside, and also includes a pair of rectangular protrusion parts 30, 32 at the right and left so as to integrate with a top seal part 6, and also includes U-shaped first inclined edge parts 34, 36 between these protrusion parts 30, 32. That is, the configuration of the fourth embodiment removes the second reinforcing part 22 from the seal-breaking guide 16 in the first embodiment, and it is formed by only the first inclined edge parts 34, 36. Inclined angles of the first inclined edge parts 34, 36 are the same as those of the first inclined edge parts 34, 36 shown in FIG. 3, and a curved edge part 80 is formed in the first reinforcing part 20 instead of the center slit 64. The seal-breaking guide 16 can be also attached to the flexible container in the shapes and processes shown in FIGS. 5(A), 5(B), 6(A), 6(B).

Even in the case where the seal-breaking guide 16 having such an arrangement is used, if a tearing force is applied to the top seal part 6 from cuts 12, 14, a breakage caused thereby can be prevented at the first inclined edge parts 34, 36 side, and it is guided to the curved edge part 80 to form a breakage piece 74, so that a symmetrical opening can be formed in a holding part 2, and the opening can be reinforced by the seal-breaking guide 16 to prevent a close contact state caused by refrigeration.

Meanwhile, although contents enclosed in the flexible container are explained as water 10 according to the fourth embodiment, the contents enclosed in the flexible container include various liquid, a fluid content, or solid or the mixture thereof, and the liquid includes industrial water such as pure water and so forth, medical water, drinking water, fruit juice, vegetable juice, and so forth and the fluid includes food staff such as mayonnaise and so forth, and the solid includes ice and so forth, and the contents enclosed in the flexible container is not limited to the water 10 shown in this embodiment.

Although a laminated film of nylon, ethylene-vinylalcohol resin and polyethylene, a laminated film of nylon, polyethylene telephtalate coated with aluminum oxide and polyethylene are exemplified as the flexible material 3, other single synthetic film or polymer film may be used.

A synthetic resin film other than the exemplified polyethylene telephtalate may be used as the seal-breaking guide 16. Although an adhesive 66 is used as a method of bonding the seal-breaking guide 16, a fixing method such as a thermal compression and so forth may be used, and also even if the seal-breaking guide 16 is formed by silk printing or coating with resin, the same effect can be expected.

Although the invention has been described with most preferable embodiment, the invention is not limited to the embodiment set forth above, and it is natural that the invention can be variously modified or changed by a person skilled in the art base on the gist of the invention which is disclosed in appended claims, and best mode for carrying out the invention, and such modification and change is included in the scope of the invention.

INDUSTRIAL APPLICABILITY

The flexible container and the seal-breaking guide thereof according to the invention is useful and adapted for a container enclosing therein fluid such as water because the opening can be easily formed in the holding part 2 by tearing a part of the flexible container from the slits formed in the seal part, and it can be torn while a tearing force and breakage force are guided by the seal-breaking guide in their operating directions, the slits can be restricted to predetermined shapes to uniformize the opening shapes, thereby preventing the irregularities of the opening shapes and error of opening.

According to the flexible container and the seal-breaking guide of the invention, since the openings can be reinforced by the seal-breaking guide, the holding part 2 can be easily restored to an original shape from an close contact state caused by sealing by a sealing member and the refrigeration to an opening state, and also the contents enclosed in the holding part 2 can be easily taken out so that it is useful and adapted for an contents therein, fluid such as water.

According to the method of forming the flexible container of the invention, the flexible container can be easily opened and the shape of the openings can be uniformized so that the flexible container can be easily fabricated, and hence it is useful.

According to the method of enclosing the liquid in the flexible container of the invention, the contents such as liquid and so forth can be enclosed in the flexible container which can be easily opened and the shape of the openings can be uniformized so that the flexible container can be easily fabricated, and the liquid such as pure water, drinking water, and so forth can be commercialized, and hence it is useful.

According to the method of enclosing the liquid in the flexible container, and water of the invention, the flexible container which is easily opened and uniformized in the shapes of the openings can be commercialized as a unit so that the liquid such as pure water, drinking water, which is facilitated in carrying and keeping thereof can be provided, and hence it is useful.

The invention claimed is:

1. A flexible container being openable by tearing comprising:

a holding part formed of a flexible material;

seal parts formed in the holding part for sealing the holding part and that can be torn to open the holding part;

single or plural cuts formed on the seal parts; and a seal-breaking guide provided adhesively in the holding part for giving guidance for a direction of tearing of the holding part, said holding part being torn from the single or plural cuts to be opened, wherein the seal-breaking guide includes:

a first reinforcing part and a second reinforcing part which are formed of a flexible material, said first and second reinforcing parts being respectively provided in symmetrical shape while extending over a ridge line of said holding part, said first and second reinforcing parts reinforcing said holding part;

an inclined edge part formed in said first and second reinforcing part, said inclined edge part giving said holding part guidance of a direction of tearing generated from said cut toward said ridge line;

a first slit formed in said first and second reinforcing parts by extending said inclined edge part, said first slit giving guidance for a direction of tearing of the holding part toward said ridge line so as to restrict a range of tearing of the holding part; and a second slit formed in said first and second reinforcing parts adjacent to but not co-linear with said first slit said second slit giving guidance for an advance of tearing of the holding part from said first slit toward said ridge line so as to restrict a range of tearing of the holding part, wherein said holding part is torn so that a part of said first and second reinforcing parts is broken to form an opening in said holding part, and an edge part of said opening is reinforced by said first and second reinforcing parts.

2. The flexible container according to claim 1, further comprising:

an inclined edge part formed at different position from the aforementioned inclined edge part in said first or second reinforcing part, said inclined edge part giving said holding part guidance of a direction of tearing generated from said cut toward said ridge line; and a terminal end recess formed in said first and second reinforcing parts in a succession of said inclined edge part while extending over said ridge line, said terminal end recess breaking a part of said seal-breaking guide, wherein said holding part is torn so that said seal-breaking guide is broken by said inclined edge part and said terminal end recess to form an opening in said holding part, and an edge part of said opening is reinforced by said seal-breaking guide.

3. A liquid enclosed in the flexible container according to claim 2.

4. The flexible container according to claim 1, further comprising:

a center slit formed in said first and second reinforcing parts while extending over said ridge line, said center slit bringing said tearing spread from said second slit into said ridge line, said center slit breaking a part of said seal-breaking guide along with a part of said holding part.

5. A liquid enclosed in the flexible container according to claim 1.

6. The flexible container according to claim 1, wherein said first and second reinforcing parts of said seal-breaking guide are formed of a flexible material of a thickness substantially the same as said flexible material forming said holding part.

7. A seal-breaking guide of a flexible container having a holding part formed of flexible material, and seal parts formed in the holding part for sealing the holding part, said flexible container can be opened by tearing, the seal-breaking guide comprising:

a first reinforcing part and a second reinforcing part which are formed of a flexible material of a thickness substantially the same as said flexible material forming said holding part, said first and second reinforcing parts being respectively provided in symmetrical shape while extending over a ridge line of said holding part, said first and second reinforcing parts reinforcing said holding part;

an inclined edge part formed in said first and second reinforcing part, said inclined edge part giving said holding part guidance of a direction of tearing generated from a cut toward said ridge line;

a first slit formed in said first and second reinforcing parts by extending said inclined edge part, said first slit giving guidance for a direction of tearing of the holding part toward said ridge line so as to restrict a range of tearing of the holding part;

a second slit formed in said first and second reinforcing parts adjacent to said first slit, said second slit giving guidance for an advance of tearing of the holding part from said first slit toward said ridge line so as to restrict a range of tearing of the holding part; and a center slit formed in said first and second reinforcing parts while extending over said ridge line, said center slit bringing said tearing spread from said second slit into said ridge line, said center slit breaking a part of said first and second reinforcing parts along with a part of said holding part, wherein said holding part is torn so that a part of said first and second reinforcing parts is broken to form an opening in said holding part, and an edge part of said opening is reinforced by said first and second reinforcing parts.

8. A seal-breaking guide of a flexible container according to claim 7, wherein said first and second slits prevent tearing from spreading on the holding part that is torn by a single or plural cuts, and guide a tearing force that is applied to the holding part in an operating direction.

9. A seal-breaking guide of a flexible container according to claim 7, further comprising plural slits for preventing tearing from spreading on the holding part, that is torn by the cuts, and for guiding tearing routes, that are generated in the holding parts within a predetermined range.

10. A seal-breaking guide of a flexible container according to claim 7, wherein said inclined edge part and said first and second slits form an opening in the holding part by collecting tearing routes for tearing the holding part while extending over the seal parts, and break the holding part and a part of the seal parts.

11. A seal-breaking guide of a flexible container according to claim 7, wherein said inclined edge part and said first and second slits are formed in a symmetrical shape at the symmetrical position or an asymmetrical shape at the asymmetrical position while sandwiching the seal part.

* * * * *